US006093225A

United States Patent [19]

Itoh

[11] Patent Number: 6,093,225

[45] Date of Patent: Jul. 25, 2000

[54] VITRIFIED ABRASIVE SOLID MASS REINFORCED BY IMPREGNATION WITH SYNTHETIC RESIN, AND METHOD OF MANUFACTURING THE SAME

[75] Inventor: Kenji Itoh, Gifu-ken, Japan

[73] Assignee: Noritake Co., Limited, Nagoya, Japan

[21] Appl. No.: 09/419,977

[22] Filed: Oct. 18, 1999

[30] Foreign Application Priority Data

Oct. 28, 1998 [JP] Japan ..... 10-306740

[51] Int. Cl.[7] ..... B24D 3/14; B24D 3/18; B24D 3/34; B24D 17/00; B24D 18/00

[52] U.S. Cl. ..... 51/295; 51/298; 51/293

[58] Field of Search ..... 51/295, 298, 307, 51/309, 293

[56] References Cited

U.S. PATENT DOCUMENTS

| | | | |
|---|---|---|---|
| 3,615,302 | 10/1971 | Rowse et al. | 51/309 |
| 4,239,501 | 12/1980 | Wirth | 51/309 |
| 5,035,724 | 7/1991 | Pukari et al. | 51/309 |
| 5,129,919 | 7/1992 | Kalinowski et al. | 51/309 |
| 5,131,923 | 7/1992 | Markhoff-Matheny et al. | 51/295 |
| 5,203,886 | 4/1993 | Sheldon et al. | 51/309 |
| 5,244,477 | 9/1993 | Rue et al. | 51/309 |
| 5,536,283 | 7/1996 | Sheldon et al. | 51/309 |
| 5,573,561 | 11/1996 | Sheldon et al. | 51/308 |
| 5,711,774 | 1/1998 | Sheldon et al. | 51/309 |
| 5,863,308 | 1/1999 | Qi et al. | 51/293 |

FOREIGN PATENT DOCUMENTS

| | | |
|---|---|---|
| 55-75461 U | 1/1980 | Japan . |
| 63-93567 | 4/1988 | Japan . |
| 10-138149 | 5/1998 | Japan . |

*Primary Examiner*—Michael Marcheschi
*Attorney, Agent, or Firm*—Oliff & Berridge, PLC

[57] ABSTRACT

An abrasive vitreous bonded solid mass having a vitrified abrasive structure comprising abrasive grains which are held together by an inorganic bonding agent, the abrasive structure is impregnated with a composition which comprises a thermosetting synthetic resin and a surfactant. The abrasive solid mass is manufactured by preparing the composition including the resin and the surfactant, impregnating the vitrified abrasive structure with the composition, and curing the composition.

18 Claims, 3 Drawing Sheets

VITRIFIED ABRASIVE SOLID MASS REINFORCED BY IMPREGNATION WITH SYNTHETIC RESIN, AND METHOD OF MANUFACTURING THE SAME

This application is based on Japanese Patent Application No. 10-306740 filed Oct. 28, 1998, the content of which is incorporated hereinto by reference.

BACKGROUND OF THE INVENTION

1. Field of the Invention

The present invention relates to a vitrified abrasive solid mass such as a vitrified grinding wheel or grindstone, which has a vitrified abrasive structure which includes abrasive grains and a vitrified bond for holding the abrasive grains together and which is reinforced by impregnation with a cured composition including a thermosetting synthetic resin and a surfactant. This invention is also concerned with a method suitable for manufacturing such a vitrified abrasive solid mass.

2. Discussion of the Related Art

An abrasive solid mass of vitrified bond type such as a vitrified grinding wheel or honing stick or bar uses a glassy bond or an inorganic bonding agent (a vitrified bond) for holding abrasive grains together so as to maintain a multiplicity of pores or voids within the vitrified abrasive structure. Owing to excellent properties of the vitrified abrasive solid mass, such as a relatively high degree of strength with which the vitrified bond holds the abrasive grains together, and a relatively easy dressing operation, the vitrified abrasive solid mass is widely used for precision grinding operations. There has been a need for an abrasive solid mass capable of performing a grinding operation with improved efficiency, to meet a recent demand for shortening of the required grinding time.

On the other hand, there has been proposed for practical use a vitrified abrasive solid mass wherein the proportion or content of the vitrified bond is made relatively high for increasing the grade of the vitrified abrasive structure, namely, for increasing the degree of strength with which the inorganic bonding agent holds the abrasive grains together. This vitrified abrasive solid mass has a higher hardness value, and can meet, to some extent, the above-indicated need for improving the grinding efficiency. However, this vitrified abrasive solid mass is not completely satisfactory. Namely, the use of the inorganic bonding agent in a relatively large proportion assures an increase in the grade of the vitrified abrasive structure, which contributes to an improvement in the grinding efficiency, but considerably reduces the porosity of the vitrified abrasive structure and results in difficult or insufficient fracturing and removal of the abrasive grains, leading to relatively easy glazing or clogging of the surface of the abrasive solid mass, relatively easy chipping of the structure, and other drawbacks encountered during use of the grinding tool. In addition, the use of the inorganic bonding agent in the relatively large proportion is likely to cause various drawbacks during the manufacture of the vitrified abrasive solid mass, such as cracking or deformation thereof and insufficient removal or burn-out of the primary binder of the inorganic bonding agent, in the firing process. The insufficient removal of the binder may cause the manufactured abrasive solid mass to have some amount of residual carbon.

Such a vitrified abrasive solid mass with reduced porosity may be manufactured by hot pressing of a mixture of the abrasive grains and the vitrified bond, and may be used for performing a highly efficient grinding operation. However, this manner of manufacturing the vitrified abrasive solid mass requires special manufacturing equipment which usually suffers from low manufacturing efficiency, leading to a relatively high cost of manufacture of the abrasive solid mass, and a significant limitation in the range of size of the abrasive solid mass that can be manufactured.

SUMMARY OF THE INVENTION

It is a first object of the present invention to provide an abrasive solid mass of vitrified bond type whose vitrified abrasive structure is reinforced by impregnation with a synthetic resin and which is less likely to suffer from the above-indicated drawbacks relating to its use and manufacture and assures a high degree of grinding efficiency.

It is a second object of the present invention to provide a method suitable for manufacturing such a vitrified abrasive solid mass having a reinforced vitrified abrasive structure.

The first object may be achieved according to a first aspect of this invention, which provides an abrasive vitreous bonded solid mass having a vitrified abrasive structure comprising abrasive grains which are held together by an inorganic bonding agent, the abrasive structure is impregnated with a composition which comprises a thermosetting synthetic resin and a surfactant.

The second object may be achieved according to a second aspect of the invention, which provides a method of manufacturing an abrasive solid mass of vitrified bond type having a vitrified abrasive structure wherein abrasive grains are held together by an inorganic bonding agent, the method comprising the steps of: preparing a composition including a thermosetting synthetic resin and a surfactant; impregnating the vitrified abrasive structure with the composition; and curing the composition.

The vitrified abrasive structure of the abrasive solid mass of the present invention has a network of pores or voids which are filled with the thermosetting synthetic resin, so as to prevent filling of the pores with metal particles which are removed from the workpiece during a grinding or honing operation using the present abrasive solid mass and which would otherwise be fused in the pores, causing clogging or glazing on the grinding or honing surface of the vitrified abrasive structure in the form of a grinding wheel or a honing bar, for example. It is also noted that since the thermosetting synthetic resin filling the pores is softer than the abrasive grains, the surface of the vitrified abrasive structure is comparatively recessed at local spots corresponding to the resin-filled pores, during the grinding or honing operation on the workpiece, so that the abrasive grains adjacent to the surface of the abrasive structure gradually fracture or break down and are removed, making it possible to prevent an excessive rise of the temperature on the workpiece surface due to an excessive amount of heat of friction which would be generated between the workpiece surface and the abrasive grains that remain dull. On the other hand, the abrasive grains which are only loosely held together by the inorganic bonding agent can be tightly held together with an additional bonding force provided by the thermosetting synthetic resin, so that the resin functions to avoid early removal of those abrasive grains, assuring a high grinding ratio.

Further, the present vitrified abrasive solid mass can be efficiently and economically manufactured by the method according to the invention, which merely includes the steps of preparing the composition including the thermosetting synthetic resin and the surfactant, impregnating the vitrified abrasive structure with the composition and curing the composition, in addition to the steps performed in the conventional method of manufacturing the known vitrified abrasive solid mass. The present method does not require conventionally used special equipment such as hot pressing equipment, which usually suffers from low manufacturing efficiency and a limitation in the range of size of the vitrified abrasive solid mass that can be manufactured.

It is further appreciated that the inclusion of the surfactant or surface active agent in the composition which includes the thermosetting synthetic resin as a major component and with which the vitrified abrasive structure is impregnated is significantly effective to control the degree of strength with which the abrasive grains are held together by the thermosetting synthetic resin, more precisely, by the composition. Namely, the surfactant appropriately contributes to a reduction in the bonding strength of the composition with respect to the abrasive grains which are tightly held together by the inorganic bonding agent with a sufficient bonding force, so that those abrasive grains may fracture or break down when they become dull. On the other hand, the surfactant does not significantly affect the bonding strength of the composition with respect to the abrasive grains which are only loosely held together by the inorganic bonding agent, so that the resin may apply an additional bonding force to those abrasive grains, to prevent early removal of the abrasive grains. Thus, the use of the surfactant together with the thermosetting synthetic resin assures only only high grinding or honing efficiency of the vitrified abrasive solid mass, but also a high grinding ratio and a high degree of durability.

Preferably, the composition including the thermosetting synthetic resin and the surfactant is prepared by adding 0.1–50% by weight of the surfactant to 100% by weight of the thermosetting synthetic resin. Within this range of content of the surfactant, the bonding strength of the composition is suitably adjusted for adequate bonding of the abrasive grains by the composition so that the bonding strength of the thermosetting synthetic resin is appropriately reduced with respect to the abrasive grains which are tightly held together by the inorganic bonding agent, but remains sufficient with respect to the abrasive grains which are loosely held together by the inorganic bonding agent. If the amount of the surf actant is smaller than the lower limit of 0.1% by weight, the above-indicated effect of the surfactant cannot be expected. If the amount of the surfactant is larger than the upper limit of 50% by weight, the bonding strength of the composition as a whole is excessively reduced, and the effect of the surf actant cannot be expected, either.

Preferably, the surfactant is a nonionic surfactant.

Preferably, grains of cubic-crystal boron nitride (CBN) or diamond are used as the abrasive grains. The abrasive grains preferably have Knoop hardness of at least 3000. It is desirable that the abrasive grains consist of or include super grains having an average particle size of 20–220$\mu$m. The particle sizes of 20 $\mu$m and 220 $\mu$m correspond to 800 and 60 meshes per linear inch, respectively. Preferably, the abrasive grains in the vitrified abrasive structure has a concentration of 20–230 parts by volume, desirably, 20–200 parts by volume. The vitrified abrasive structure desirably has a porosity of 20–75% by volume, preferably, 30–65% by volume.

The inorganic bonding agent or vitrified bond is preferably a borosilicate glass or a crystallized glass. In particular, a crystallized glass in which willemite ($Zn_2SiO_4$) precipitates is preferably used as the vitrified bond. The inorganic bonding agent preferably has a thermal expansion coefficient on the order of $2\times10^{-6}$/K at a temperature from the room temperature to 500° C., so that the considerably fine abrasive grains can be tightly bonded together by the inorganic bonding agent.

It is preferable that the vitrified abrasive structure after it is fired includes 15–35% by volume of the inorganic bonding agent. The vitrified abrasive structure may include as an aggregate a pore forming agent such as an inorganic baloning agent or other inorganic hollow substance.

BRIEF DESCRIPTION OF THE DRAWINGS

The above and other objects, features, advantages and technical and industrial significance of this invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
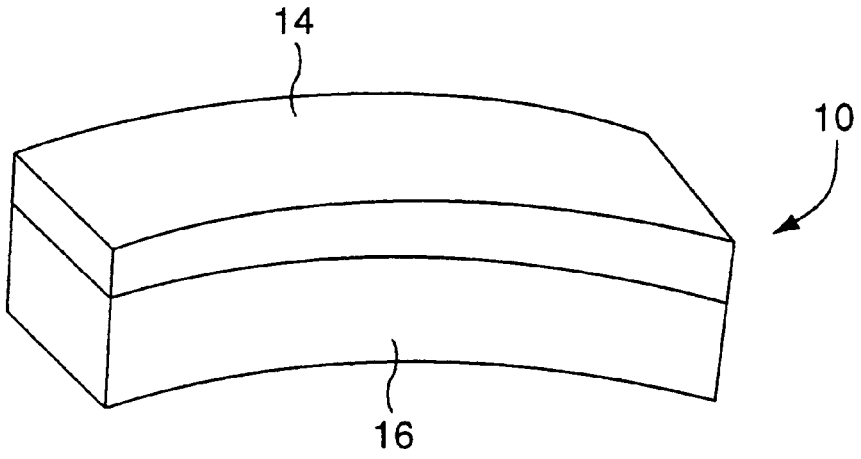
FIG. 1 is a perspective view showing one of a multiplicity of abrasive segments of a segmented vitrified grinding wheel, which abrasive segments are reinforced by impregnation thereof with a composition including a synthetic resin and a surfactant according to one embodiment of this invention.
Figure 2:
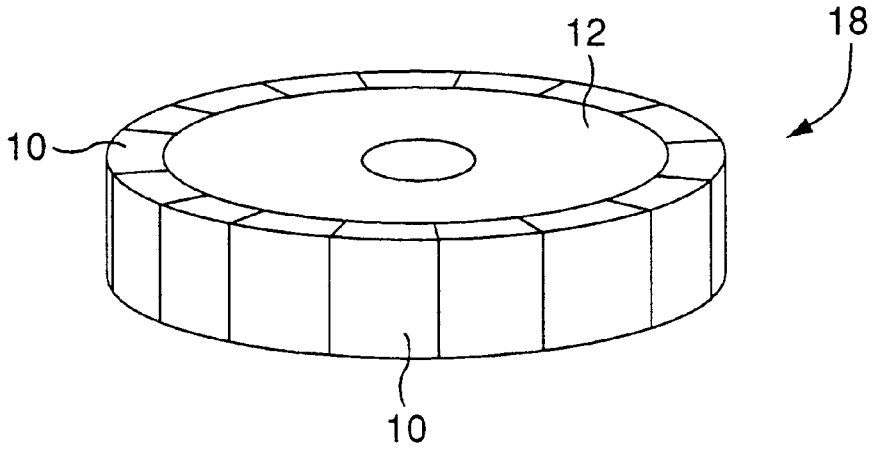
FIG. 2 is a perspective view of the segmented vitrified grinding wheel whose radially outer portion consists of the abrasive segments arranged in the circumferential direction.

Referring first to FIGS. 1 and 2, a segmented vitrified grinding wheel 18 shown in FIG. 2 consists of an inner core 12, and a circular array of abrasive segments 10 which are bonded to the outer circumferential surface of the core 12 with a suitable bonding adhesive such as an epoxy resin adhesive such that there does not exist any gap or clearance between the adjacent abrasive segments 10. The inner core 12 is formed of a metallic material, a fiber-reinforced synthetic resin or a vitrified abrasive. Each of the abrasive segments 10 arranged in the circumferential direction of the grinding wheel 18 is a vitrified abrasive solid mass in the form of an arcuate block having a curvature whose center lies on the axis of the grinding wheel 18. The circular array of the abrasive segments 10 is also considered to be a vitrified abrasive solid mass.

Each abrasive segment 10 consists of a radially outer layer 14 having an outer grinding surface, and a radially inner layer 16 which is formed integrally with the outer layer 14 and which functions as a base support layer for mechanically supporting the outer layer 14. Each of the outer and inner layers 14, 16 consists of abrasive grains and an inorganic bonding agent or a vitrified bond by which the abrasive grains are held together. Generally, the outer and inner layers 14, 16 use the same kind of inorganic bonding agent, but use different kinds of abrasive grains. For instance, the outer layer 14 includes super grains of cubic-crystal boron nitride (CBN) or diamond, which have a Knoop hardness value of at least 3000, while the inner layer 16 includes ordinary abrasive grains such as fused alumina grains or silicon carbide grains, which are relatively inexpensive. Preferably, the super grains used for the outer layer 14 have an average particle size within a range of 20–220 μm. The lower and upper limits of 20 μm and 220 μrespectively correspond to 800 and 60 meshes per linear inch.

Figure 3:
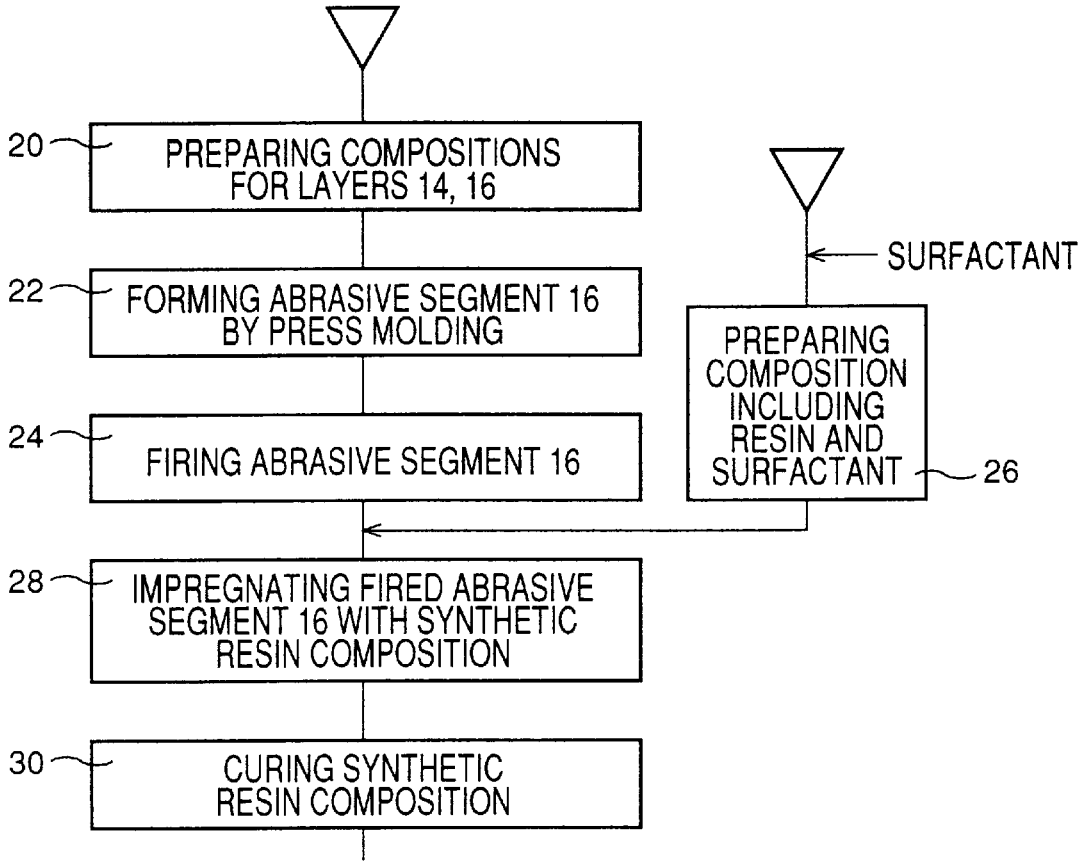
FIG. 3 is a view illustrating a process of manufacturing the abrasive segment of FIG. 1.

Each of the abrasive segments 10 used for the segmented vitrified grinding wheel 18 may be manufactured by a method illustrated in the block diagram of FIG. 3. Initially, step 20 is implemented to prepare mixtures or compositions for the radially outer and inner layers 14, 16 of the abrasive segment 10. Each of the compositions for the outer and inner layers 14, 16 includes abrasive grains, an inorganic or glassy bonding agent, a caking additive such as dextrin, and suitable additives such as an organic substance and an inorganic balooning agent or other pore forming agent. Desired proportions of these materials are weighed and well mixed under stirring to prepare the composition in a powdered form for each of the outer and inner layers 14, 16. In the present embodiment, the inorganic bonding agent consists of a crystallized glass in which willemite ($Zn_2SiO_4$ precipitates. This crystallized glass has a coefficient of thermal expansion on the order of $2\times10^{-6}$/K at a temperature between the room temperature and 500° C. The proportion of the inorganic bonding agent is determined so that the fired vitrified abrasive structure of the abrasive segment 10 includes 15–35% by volume of the inorganic bonding agent.

The step 20 of preparing the compositions for the outer and inner layers 14, 16 is followed by step 22 in which the prepared compositions are introduced into a suitable metal mold whose cavity has a shape following the abrasive segment 10 to be manufactured. The compositions in the mold are compressed or compacted by a press, to form an unfired or green precursor for the abrasive segment 10. Then, step 24 is implemented to fire or burn the unfired precursor into the fired abrasive segment 10. In this firing step 24, the caking additive included in the compositions is burnt out, while the inorganic bonding agent is fused to bond the abrasive grains together, so that the abrasive segment 10 has a porous vitrified abrasive structure having a network of continuous pores or voids, wherein the abrasive grains are held together by the inorganic bonding agent. In this vitrified abrasive structure, the abrasive grains have a concentration of 10–230, preferably, 20–200. The vitrified abrasive structure has a porosity of 20–75% by volume, preferably, 30–65% by volume.

In the meantime, step 26 is implemented to prepare a composition including: an epoxy resin such as bisphenol A in a fluid or liquid state as a primary or major component; and a curing agent such as a polyamide resin in a fluid or liquid state; and a nonionic surfactant or surface active agent such as polyoxyethylene styrylphenyl ether, dodecylbenzene sulfonate and polyethylene glycol ether. The surfactant is added in an amount of 0.1–50% by weight to 100% by weight of the mixture of the epoxy resin (thermosetting synthetic resin as the primary or major component) and the curing agent. The epoxy resin, curing agent and surfactant are mixed into the composition.

In the following step 28, the fired vitrified abrasive structure of the abrasive segment 10 which has the network of the multiple continuous pores is impregnated with the composition including the epoxy resin, curing agent (polyamide resin) and surfactant. This step 28 may be performed by: pouring the composition in the fluid or liquid state in a suitable container such that the mass of the fluid or liquid composition in the container has a depth of about 10 mm; immersing the entirety of the porous abrasive segment 10 in the mass of the composition; and evacuating the porous abrasive segment 10 so that the network of the continuous pores is filled with the composition whose major component is the thermosetting synthetic resin (epoxy resin) and which includes a suitable amount of the surfactant. However, a selected portion of the abrasive segment 10, for instance, the radially outer layer 14 of the abrasive segment 10 may be immersed in the mass of the fluid composition.

The step 28 is followed by step 30 of holding the resin-impregnated abrasive segment 10 at a suitable temperature for a suitable length of time, for instance, at the room or ambient temperature for 12 hours, so that the composition including the thermosetting synthetic resin (epoxy resin) and the surfactant which fill the pores in the vitrified abrasive structure of the abrasive segment 10, in particular, the thermosetting synthetic resin, is cured or hardened.

In the abrasive segment 10 thus manufactured, the pores in the vitrified abrasive structure are filled with the thermosetting synthetic resin in the form of the epoxy resin, so as to prevent filling of the pores with metal particles which are removed from the workpiece during a grinding or honing operation using the grinding wheel 18 and which would otherwise be fused in the pores, causing clogging or glazing on the grinding or honing surface of the vitrified abrasive structure of each abrasive segment 10. It is also noted that since the epoxy resin as the thermosetting synthetic resin filling the pores is softer than the abrasive grains, the surface of the vitrified abrasive structure is comparatively recessed at local spots corresponding to the resin-filled pores, during the grinding or honing operation on the workpiece, so that the abrasive grains adjacent to the surface of the abrasive structure gradually fracture or break down and are removed, making it possible to prevent an excessive rise of the temperature on the workpiece surface due to an excessive amount of heat of friction which would be generated between the workpiece surface and the abrasive grains that remain dull. On the other hand, the abrasive grains which are only loosely held together by the inorganic bonding agent can be tightly held together with an additional bonding force provided by the thermosetting synthetic resin, so that the resin functions to avoid early removal of those abrasive grains, assuring a high grinding ratio.

Further, the present vitrified abrasive segment 10 can be efficiently and economically manufactured by the method described above, which merely includes the steps 26, 28, 30 of preparing the composition including the thermosetting synthetic resin and the surfactant, impregnating the vitrified abrasive structure with the composition and curing the composition, in addition to the steps performed in the conventional method of manufacturing the known vitrified abrasive grinding wheel, for instance. The present method does not require conventionally used special equipment such as hot pressing equipment, which usually suffers from low manufacturing efficiency and a limitation in the range of size of the vitrified abrasive segment 10 that can be manufactured. It is further appreciated that the inclusion of the surfactant or surface active agent in the composition which includes the thermosetting synthetic resin as a major component and with which the vitrified abrasive structure of the abrasive segment 10 is impregnated is significantly effective to control the degree of strength with which the abrasive grains are held together by the epoxy resin, more precisely, by the composition. Namely, the surfactant appropriately contributes to a reduction in the bonding strength of the composition with respect to the abrasive grains which are tightly held together by the inorganic bonding agent with a sufficient bonding force, so that those abrasive grains may fracture or break down when they become dull. On the other hand, the surfactant does not significantly affect the bonding strength of the composition with respect to the abrasive grains which are only loosely held together by the inorganic bonding agent, so that the resin may apply an additional bonding force to those abrasive grains, to prevent early removal of the abrasive grains. Thus, the use of the surfactant together with the epoxy resin assures only only high grinding or honing efficiency of the vitrified grinding wheel 18, but also a high grinding ratio and a high degree of durability.

Experiments were conducted to clarify a relationship between the grinding performance of the segmented grinding wheel 18 using the abrasive segments 10 and the proportion of the surfactant with respect to the epoxy resin.

EXAMPLES

The inner core portion 12 of the segmented grinding wheel 18 manufactured in this experiment is a steel disk having a center mounting hole, while the radially outer and inner layers 14, 16 of each of the abrasive segments 10 of the wheel 18 have the following compositions:

| | Parts by Volume |
|---|---|
| - Outer Layer 14 | |
| CBN grains (Type-I #80/#100 available from General Electrics) | 50.0 |
| Vitrified bond | 18.0 |
| Caking additive | 10.0 |
| - Inner Layer 16 | |
| Silicon carbide grains (#80) | 50.0 |
| Vitrified bond | 18.0 |
| Caking additive | 10.0 |

An unfired or green abrasive structure formed of the above-indicated compositions were fired at 900° for five hours, to prepare each abrasive segment 10 having a length of 70 mm (as measured in the circumferential direction of the grinding wheel), a width of 10.4 mm (corresponding to the thickness or axial dimension of the grinding wheel) and a thickness of 7.4 mm. The outer layer 14 has a thickness of 3.8 mm while the inner layer has a thickness of 3.6 mm. In the meantime, 22.0 parts by weight of epoxy resin as the major component and 8.0 parts by weight of a curing agent for curing the epoxy resin were mixed under stirring to obtain a mixture. The epoxy resin was bisphenol A, while the curing agent was a polyamide resin.

Then, six different compositions Nos. 1 and 3–7 as indicated in TABLE 1 were prepared by adding respective six different amounts (parts by weight) of polyoxyethylene styrylphenyl ether as a nonionic surfactant to the mixture of epoxy resin (22.0 parts by weight) and curing agent (8.0 parts by weight), while these three components were mixed together under stirring. The surfactant had a concentration of about 70%.

TABLE 1

| Compositions | Epoxy Resin | Curing Agent | Surfactant | (wt. %) |
|---|---|---|---|---|
| No. 1 | 22.0 | 8.0 | 1.0 | (3.2) |
| No. 3 | 22.0 | 8.0 | 5.0 | (14.3) |
| No. 4 | 22.0 | 8.0 | 10.0 | (25.0) |
| No. 5 | 22.0 | 8.0 | 30.0 | (50.0) |
| No. 6 | 22.0 | 8.0 | 0.5 | (1.6) |
| No. 7 | 22.0 | 8.0 | 0 | (0.0) |

As in the curing step 30 described above by reference to FIG. 3, specimens of the abrasive segment 10 were impregnated with the respective compositions Nos. 1 and 3–7. Vitrified grinding wheels Nos. 1 and 3–7 were manufactured by using respective circular arrays of abrasive segments 10 which were impregnated by the respective six different compositions Nos. 1 and 3–7. The core portion 12 of each grinding wheel had an outside diameter of 366 mm so that the circular array of abrasive segments 10 had an inside diameter of about 366 mm. A grinding wheel No. 2 was prepared using an array of abrasive segments which were not impregnated with a composition including the epoxy resin and surfactant. The compositions (parts by volume) of each abrasive segment and the bending strength (MPa) of the grinding wheel Nos. 1–7 are indicated in TABLE 2. To obtain the bending strength, a transverse test was conducted according to JIS G-0202.

TABLE 2

| Wheel Nos. | CBN | Bond | Resin | Void | Bending strength |
|---|---|---|---|---|---|
| No. 1 | 50.0 | 18.0 | 28.8 | 3.2 | 68.0 MPa |
| No. 2 | 50.0 | 18.0 | 0.0 | 32.2 | 52.0 MPa |
| No. 3 | 50.0 | 18.0 | 25.2 | 6.8 | 65.3 MPa |
| No. 4 | 50.0 | 18.0 | 21.6 | 10.4 | 63.5 MPa |
| No. 5 | 50.0 | 18.0 | 14.3 | 17.7 | 55.9 MPa |
| No. 6 | 50.0 | 18.0 | 30.8 | 1.2 | 69.5 MPa |
| No. 7 | 50.0 | 18.0 | 31.8 | 0.2 | 71.5 MPa |

Using the grinding wheel Nos. 1–7, grinding operations were performed on a cylindrical workpiece on a cylindrical grinding machine, in the following conditions:

Workpiece: 60 mm diameter; SCM 435

Type of grinding operation: Plunge grinding to remove stock over an axial length of 5 mm, using a coolant Depth of grinding: 11.5 mm (in the radial direction)

Peripheral speed of the wheel: 160 m/s

Grinding efficiency: 70 $mm^3$/mm

Results of the grinding operations by the grinding wheels Nos. 1–7 are indicated in TABLE 3.

TABLE 3

| Wheels | No. 1 | No. 2 | No. 3 | No. 4 | No. 5 | No. 6 | No. 7 |
|---|---|---|---|---|---|---|---|
| Resin Impregnation | YES | NO | YES | YES | YES | YES | YES |
| Grinding Ratio | 2300 | 1200 | 2800 | 1800 | 1200 | 1800 | 1200 |

TABLE 3-continued

| Wheels | No. 1 | No. 2 | No. 3 | No. 4 | No. 5 | No. 6 | No. 7 |
|---|---|---|---|---|---|---|---|
| Ground Surface Burn-out | NONE | YES | NONE | NONE | NONE | NONE | NONE |
| Wheel Surface Glazing | NONE | YES | NONE | NONE | NONE | NONE | NONE |
| Wheel Chipping | NONE | YES | NONE | NONE | NONE | NONE | NONE |

It will be understood that the effect of the surfactant on an increase in the grinding ratio is no so high with the grinding wheel No. 4 wherein the content of the surfactant is 25.0% by weight, and is considerably low with the grinding wheel No. 5 wherein the content of the surfactant is 50.0% by weight. It will also be understood that the effect of the surfactant on the grinding ratio is also relatively low with the grinding wheel No. 6 wherein the content of the surfactant is 1.6% by weight, and is considerably low with the grinding wheel No. 7 which does not use the surfactant. However, it is considered that some effect of the surfactant is obtained where the content of the surfactant is within a range of 0.1–50.0% by weight. It will be understood that the effect of the surfactant where the content of the surfactant is 1.6% (wheel No. 6) and 25.0% (wheel No. 4) by weight is 1.5 times that where the surfactant is not used (wheel No. 7).

Figure 4:
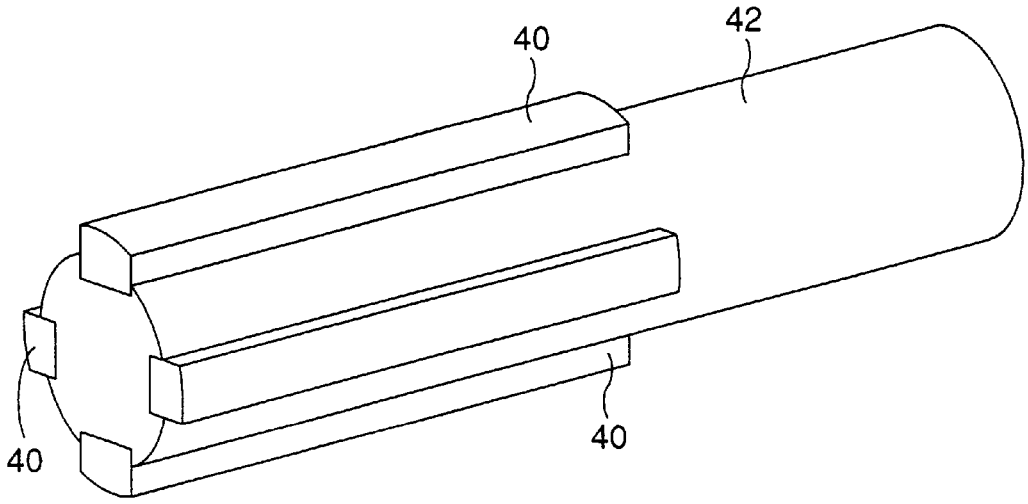
FIG. 4 is a perspective view showing a main spindle having honing bars fixed thereof, each of which is a vitrified abrasive block reinforced by impregnation thereof with a composition including a synthetic resin and a surfactant, according to another embodiment of this invention.

Referring next to FIG. 4, there is shown a main spindle 42 on which four vitrified abrasive bars 40 are fixed as honing bars, according to a second embodiment of this invention. The four abrasive bars 40 are fixed on the circumferential surface of the main spindle 42 such that the abrasive bars 40 extend in the axial direction of the main spindle and are evenly spaced apart from each other in the circumferential or rotating direction of the main spindle. Each abrasive bar 40 is an elongate member having a generally rectangular transverse cross section. Described more precisely, each abrasive bar 40 has a honing outer surface shaped such that the honing outer surfaces of the four abrasive bars 40 cooperate to generally define a cylindrical surface. Namely, the honing outer surface is an arcuate or part-cylindrical surface. Each of the abrasive bars 40 is manufactured by a method substantially identical with the method which has been described above by reference to FIG. 3. Like each of the abrasive segments 10, each of the abrasive bars 40 is also considered to be an abrasive solid mass of vitrified bond type.

In a honing operation performed by the main spindle 42 equipped with the abrasive bars 40, the abrasive bars 40 are held at their honing surfaces onto the inner circumferential surfaces of a hole being honed, with a suitable biasing device which generates a biasing force in the radially outward direction of the main spindle 42. The main spindle 42 is reciprocated in the axial direction while it is rotated about its axis.

While the presently preferred embodiments of the present invention have been described above with a certain degree of particularity, by reference to the accompanying drawings, it is to be understood that the invention is not limited to the details of the illustrated embodiments, but may be otherwise embodied.

For instance, a phenol resin rather than an epoxy resin may be used as the thermosetting synthetic resin included in the composition with which the vitrified abrasive structure of the abrasive segment 10 or bar 40 is impregnated to fill the pores in the abrasive structure.

While the abrasive segment 10 consists of the radially outer layer 14 assigned to perform a grinding operation and the radially inner layer 16 backing up the outer layer 14, the abrasive segment may consist of a single layer formed of the same composition as used for the outer layer 14.

Although the outer layer 14 of the abrasive segment 10 in the Examples includes CBN grains, it is possible to use other abrasive grains such as diamond grains, Alundum grains (fused alumina grains; basic refractory clay), and Carborundum grains (silicon carbide grains).

While the grinding wheel 18 shown in FIG. 2 has a circular array of the abrasive segments 10, the grinding wheel may use a single integral annular abrasive solid mass.

It is to be understood that the invention may be embodied with various other changes, modifications and improvements, which may occur to those skilled in the art, without departing from the spirit and scope of the invention defined in the following claims.

What is claimed is:

1. An abrasive vitreous bonded solid mass having a vitrified abrasive structure comprising abrasive grains which are held together by an inorganic bonding agent, wherein the abrasive structure is impregnated with a composition which comprises a thermosetting synthetic resin and a surfactant.

2. An abrasive solid mass according to claim 1, wherein said surfactant is a nonionic surfactant.

3. An abrasive solid mass according to claim 1, wherein said abrasive grains have Knoop hardness of at least 3000.

4. An abrasive solid mass according to claim 1, wherein said abrasive grains have an average size of 20–220 $\mu$m.

5. An abrasive solid mass according to claim 1, wherein said abrasive grains are present in said vitrified abrasive structure in an amount within a range of 10–230 parts by volume.

6. An abrasive solid mass according to claim 1, wherein said vitrified abrasive structure has a porosity of 20–75% by volume.

7. An abrasive solid mass according to claim 1, wherein said abrasive grains include grains of cubic-crystal boron nitride.

8. An abrasive solid mass according to claim 1, wherein said abrasive grains include diamond grains.

9. An abrasive solid mass according to claim 1, wherein said inorganic bonding agent includes a crystallized glass in which willemite precipitates.

10. An abrasive solid mass according to claim 1, wherein said vitrified abrasive structure further comprises a pore forming agent.

11. A method of manufacturing an abrasive vitreous bonded solid mass having a vitrified abrasive structure comprising abrasive grains which are held together by an inorganic bonding agent, said method comprising the steps of:

(a) preparing a composition comprising a thermosetting synthetic resin and a surfactant;

(b) impregnating said vitrified abrasive structure with said composition; and (c) curing said composition.

12. A method according to claim 11, wherein said step of preparing a composition comprising a thermosetting synthetic resin and a surfactant comprises adding 0.1–50% by weight of said surfactant to 100% by weight of said thermosetting synthetic resin.

13. A method according to claim 11, further comprising, prior to step (a), the steps of:

forming a unfired precursor for said vitrified abrasive structure comprising said abrasive grains and said inorganic bonding agent; and firing said unfired precusor to prepare said vitrified abrasive structure.

14. A method according to claim 11, wherein said step of preparing said composition further comprises adding a curing agent to said thermosetting synthetic resin and said surfactant.

15. A method according to claim 11, wherein said thermosetting synthetic resin comprises an epoxy resin.

16. A method according to claim 12, wherein said step of impregnating said vitrified abrasive structure with said composition comprises at least partially immersing said vitrified abrasive structure in said composition in a fluidic state.

17. A method according to claim 16, wherein said step of impregnating said vitrified abrasive structure with said composition further comprises evacuating said vitrified abrasive structure while a portion of said vitrified abrasive structure is at least partially immersed in said composition in the fluidic state.

18. An abrasive solid mass according to claim 1, wherein said inorganic bonding agent is present in an amount of 15–35% by volume.

* * * * *